US007819727B2

(12) United States Patent
Huang et al.

(10) Patent No.: US 7,819,727 B2
(45) Date of Patent: Oct. 26, 2010

(54) PUSH-PULL TYPE VENTILATION HOOD

(75) Inventors: Rong Fung Huang, Taipei (TW); Yu-Kang Chen, Gueiren Township, Tainan County (TW); Tung-Sheng Shih, Shijr (TW); Cheng-Ping Chang, Shijr (TW); Wen-Yu Yeh, Shijr (TW); Chun-Wan Chen, Shijr (TW); Shin Yi Lin, Taipei (TW); Shun-Yuan Jan, Taipei (TW)

(73) Assignee: Institute of Occupational Safety and Health Council of Labor Affairs, Shijr, Taipei (TW)

( * ) Notice: Subject to any disclaimer, the term of this patent is extended or adjusted under 35 U.S.C. 154(b) by 938 days.

(21) Appl. No.: 10/885,622

(22) Filed: Jul. 8, 2004

(65) Prior Publication Data

US 2006/0009147 A1 Jan. 12, 2006

(51) Int. Cl.
*F24F 13/00* (2006.01)

(52) U.S. Cl. ..... 454/56; 454/58; 454/63

(58) Field of Classification Search ..... 454/49, 454/56, 57, 58, 59; 126/299 F, 299 R, 299 D
See application file for complete search history.

(56) References Cited

U.S. PATENT DOCUMENTS 5,232,152 A * 8/1993 Tsang ..... 236/44 A
5,447,468 A * 9/1995 Tener et al. ..... 454/58
5,697,838 A * 12/1997 Morris ..... 454/62
5,716,267 A * 2/1998 Hambleton et al. ..... 454/56
6,428,408 B1 * 8/2002 Bell et al. ..... 454/56
6,461,233 B1 * 10/2002 Gilkison et al. ..... 454/57

* cited by examiner

*Primary Examiner*—Steve McAllister
*Assistant Examiner*—Helena Kosanovic
(74) *Attorney, Agent, or Firm*—Jackson IPG PLLC

(57) ABSTRACT

The present invention is a push-pull ventilation hood having a push device to obtain a push air flow and a pull device to exhaust contaminant flow with an exhaust opening and the two devices properly coordinated with each other, wherein, when the push flow flows through a contaminant source, a contaminated flow of the push flow is exhausted through the exhaust opening. Based on the design process according to the present invention, a push-pull hood with the highest efficiency of push velocity can be designed and the push-pull hood can economically and effectively control the contaminant source.

14 Claims, 9 Drawing Sheets

PUSH-PULL TYPE VENTILATION HOOD

FIELD OF THE INVENTION

The present invention relates to a push-pull type ventilation hood. More particularly, the present invention relates to that, by a specific design process and an improvement in structure design, the ability of a push-pull hood on capturing the contaminant flow is improved. The present invention uses smoked-flow visualization to find out four characteristic flow regimes for different types of push flow and pull flow, wherein the four characteristic flow regimes are regimes of dispersion, transition, encapsulation and strong suction; and wherein the contaminant can be safely captured in the modes of encapsulation and strong suction. By the specific design process, the present invention find out the most effective push velocity and pull velocity together with the design of a flange to make a push-pull hood capable of economically and effectively controlling the contaminant source.

DESCRIPTION OF THE RELATED ARTS

The design of ventilation has progressed a lot during the past years, so the role of ventilation hood is becoming increasingly important. As one of the targets for an advanced country, enterprises are responsible to act according to laws and regulations of occupational safety and health when chasing profit growth. It means that they should provide a harmless, safe and easy working environment for the laborers, wherein the dispersion of contaminants in industrial places is always a marked topic.

From a dispersing contaminant source, such as an open-surface tank for electroplating or acid-etching, a great amount of the contaminant will be released from the liquid surface quite fast together with the reaction temperature inside the tank to make the environment around seriously affected and the flow field around quite obviously crowded so that the laborers' health and the industrial operation safety will be directly threatened. Traditionally, to deal with an open-surface tank of a dispersing contaminant source, a side-type hood is usually used for operational convenience. But, because the flow is crooked owing to the dispersion velocity and the tank surface width is too wide, the pulling capacity of a general partial-exhausting hood is not able to be effectively controlled. According to the newer European and American design concept, a side-type hood is not suitable for exhausting high toxic contaminants but a push-pull hood is preferred.

The flow field of a push-pull hood comprises a push flow, a pull flow and a rising flow. According to the principle that the operational distance of the push flow is far greater than that of the pull flow, a greater capture distance is possible and it is one of the most efficient methods now for controlling the partial-exhausting over the dispersing contaminant source. After the push flow is being blown out, the flow around will be embroiled; and, owing to the pull velocities at both the upper and the lower side of the push flows are not uniform with the rising velocity, a vortex dispersion structure will be formed. Then the structure is directed into a pull hood of a exhaust opening under the influence of the pull flow. Because the push flow source is a dispersing source too, the flow field around will be crowded and dispersed. Therefore, the design and the use of a push-pull hood should be more careful to prevent a more serious dispersion of the contaminant source in case of an improper design.

During 1980s, according to the experiment results, American scholars, Huebener and Hughes, suggested the minimum required amount of the push flow and the pull flow so that 50% of the airflow of a push-pull hood can be saved as compared with that of a side-type one. Klein successively affirmed that the experiment results can be applied in the actual operation places. Simultaneously, Japanese investigators Shibata et al found that the push flow would be deflected under the influence of an interfering flow. In 1990s, owing to the development of the calculating methods of the hydrodynamics, numerical calculation methods can be used on exploring the issues concerning the push-pull hood.

Until now, design criterion for push-pull hood employed by the ACGIH is the most widely applied in industries. According to the ACGIH design criterion, as disclosed in "Industrial Ventilation", *A manual of recommended practice,* 24th ed. American Conference of Governmental Industrial Hygienists, 2001, pp. 108–109, the design of the push-pull hood varies liquid-surface rising velocities by different temperatures, yet itself fails to be adjusted by those temperatures. According to the present invention, the operation point of the ACGIH falls between a transition mode and a dispersion mode at normal temperature. As the rising velocity increases, the dispersion of the contaminant will increase too. Therefore, the suggested values are only suitable for contaminants with lower dispersion velocity to make the operation points fall in the transition mode and the encapsulation mode. Yet, when the dispersion velocity of the contaminants is getting higher, the operation point will fall in the dispersion mode and the transition mode; and, because the push velocity would be required to be higher, the power will be consumed more.

According to the technique disclosed in "Characteristics and design method for push-pull hoods," by Shibata et al, *ASHRAE Trans*. Part I. Vol. 88, 1982, pp. 535–570, the rising flow should be considered as a factor applied only at some specific open-surface tank, which is similar to the minimum pull flow amount. Although, when in a middle or high push velocities, the operation points are mostly fall in a transition mode or an encapsulation mode. But, when the push velocities are low, the minimum pull velocities are mostly fall in a dispersion mode or a transition mode which is actually close to dispersing the contaminant.

Therefore, an effective and widely-applied push-pull hood should be provided, which is convenient to the operation and is able to prevent or reduce the side flow so that the contaminant flow can be effectively and safely captured by the pull device. The present invention recognizes four basic modes of a flow field; and, by controlling the flow field mode, the present invention applies its characteristics to a wider range of open-surface tanks and totally capture the contaminant.

SUMMARY OF THE INVENTION

The main purpose of the present invention relates to a push-pull type ventilation hood. More particularly, the present invention relates to a design of a push-pull hood for pulling and exhausting contaminant flow. By the present invention, the dispersion of the contaminant in the laborers' work environment can be reduced; the safety and health of the industrial environments can be improved; the probability of occupational diseases among laborers can be reduced; and, the productivity of the country can also be improved at the same time.

Another purpose of the present invention is to improve the efficiency of the exhausting and capturing; to reduce the power consumption in the pulling process; to provide a control on the dispersing contaminant in an economical and effective way for the business unit; and, to further provide an improvement on guarding and controlling the work environment.

The third purpose of the present invention is to make a contribution for solving the problems of sanitation and ventilation for Industries by effectively applying the present invention, wherein the problems comprise the crosswind caused by opening or shutting doors or windows, the crosswind caused by operators' actions, the dispersion of the contaminant flow and the partial exhausting in the process of packing granular materials. Furthermore, the present invention not only can be applied in the industry field, but also be applied in the design of livelihood equipments like the exhaust fan.

The fourth purpose of the present invention is to provide a specific design process together with setting a flange to make a push-pull hood which consumes less power and is highly efficient and produces low pollution.

BRIEF DESCRIPTION OF THE DRAWINGS

The present invention will be better understood from the following detailed description of the preferred embodiment of the present invention, taken in conjunction with the accompanying drawings, in which.

DESCRIPTION OF THE PREFERRED EMBODIMENTS

The following descriptions of the preferred embodiment are provided to understand the features and the structures of the present invention.

Figure 1:
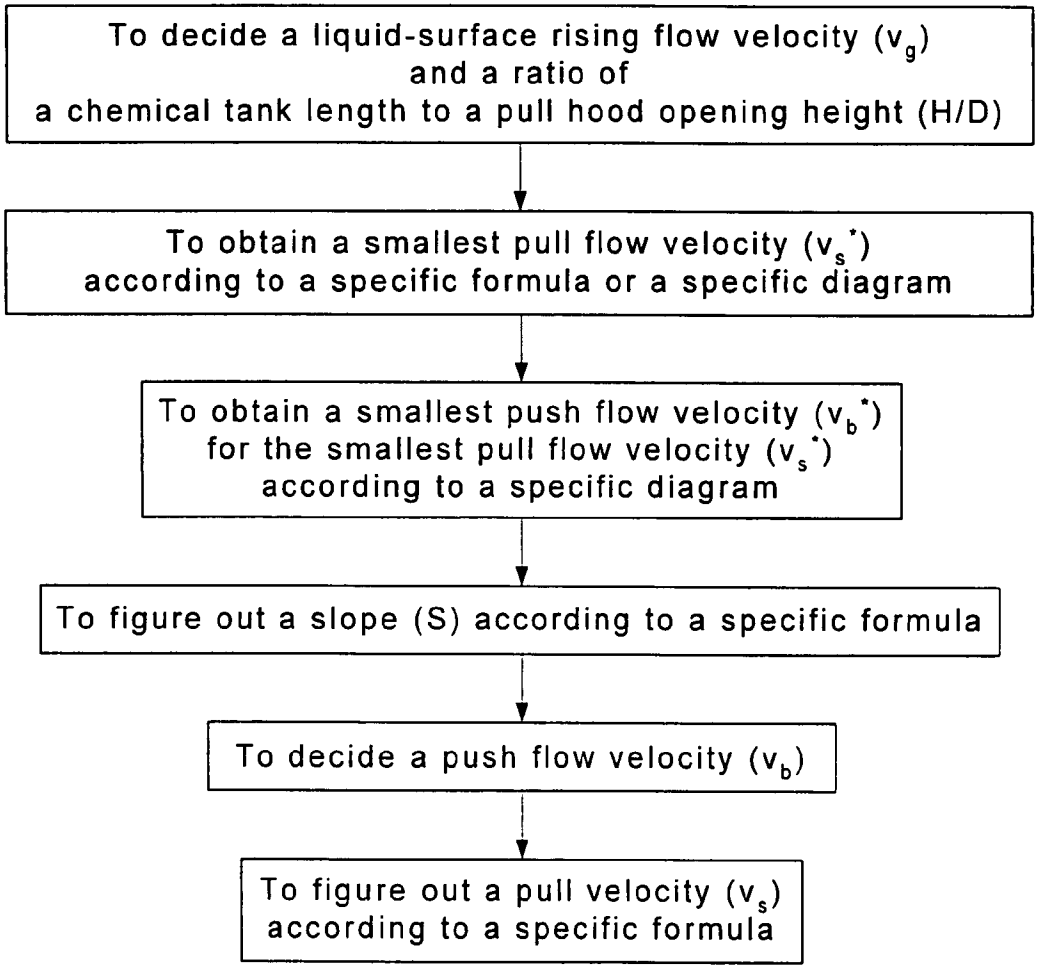
FIG. 1 is a flow chart of the design method according to the present invention.

From the experiment results of the preferred embodiment according to the present invention, it can be found that many parameters would affect the design of a push-pull hood. These parameters include the parameters concerning the flow field velocity, such as the average flow velocity per unit area of the push hood opening ($v_b$), the average flow velocity per unit area of the pull hood opening ($v_s$) and the rising velocity of simulated chemical vapor ($v_g$); and the parameters concerning the geometrical design, such as the chemical tank length (H), the pull hood opening height (D) and the push hood opening height (E); and so on. Although there are too many experimental parameters to be controlled, based on the experiment results according to the present invention, a simple and effective design process is provided with regard to the importance of the experimental parameters and the design sequence. Please refer to FIG. 1, which is a flow chart of the design process according to the present invention. As show in the figure, the design process according the present invention comprises:

Step 1: At first, to decide a liquid-surface rising velocity ($v_g$) and a ratio of a chemical tank length to a pull hood opening height (H/D);

Step 2: To obtain a smallest pull velocity ($v_s$*) by substituting parameters in formula 1 or formula 2 with the values obtained in step 1 or by referring to FIG. 4 or FIG. 5, wherein the formula 1 is:

$$(v_s^*/v_g)=(-1718.285v_g^3+981.659v_g^2-215.819v_g+29.003)\times\exp[(-7.264v_g^3+2.881v_g^2-0.305v_g+0.062)(H/D)]$$

and the formula 2 is:

$$(v_s^*/v_g)=(-3362.250v_g^3+1893.890v_g^2-365.600v_g+45.997)\times\exp[(-5.182v_g^3+1.930v_g^2-0.215v_g+0.053)(H/D)];$$

Step 3: To obtain a smallest push velocity ($v_b$*) for the smallest pull velocity ($v_s$*) by referring to FIG. 6, FIG. 7 or FIG. 8 with the values obtained in step 1 and step 2;

Step 4: to figure out a corresponding slope (S) by substituting parameters in formula 3 or formula 4 with the values obtained in step 1, wherein the formula 3 is:

$$S=0.0215H/D+2.0756$$

and the formula 4 is:

$$S=0.0164H/D+1.6264;$$

Step 5: To decide a push velocity ($v_b$), which should better be a value between the smallest push velocity ($v_b$*) and 1 m/s (meter per second); and Step 6: To figure out a pull velocity ($v_s$) by substituting parameters in formula 5 with the values obtained in step 2 and step 5, wherein the formula 5 is:

$$v_s>=v_s+S\times(v_b-v_b^*).$$

Based on the above steps of a design process according to the present invention, a high-efficient push-pull hood with a proper push velocity and pull velocity can be designed, taken the preferred embodiment according to the present invention as an example.

Figure 9:
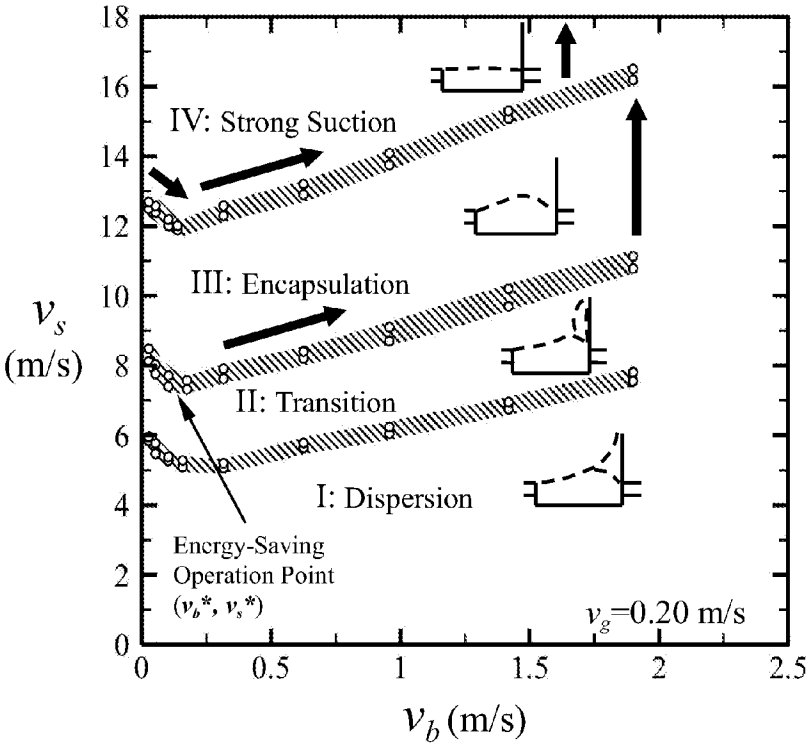
FIG.9(Prior Art)
FIG. 9 is a view of the flow regimes of the typical push-pull hood according to the prior art.

On the other hand, please refer to FIG. 9, which is a view of the flow regimes of the conventional push-pull hood according to the prior art. As shown in the figure, in the flow field of the push-pull hood according to the prior art, basically the flow field modes include modes of dispersion, transition, encapsulation and strong suction. As long as the velocity ratio of the push-pull flow to the liquid-surface rising flow is maintained in the operation modes of encapsulation and strong suction, the dispersed contaminant can be safely captured and the push-pull hood can show its ability on capturing the contaminant. But, in the mode of strong suction, the flow field would become a 3-D (dimension) flow field, which is formed into an arc-shaped capture area that the contaminant flow may be dispersed and the dispersion can not be easily controlled. To solve this problem, under the mode of strong suction, at least a flange must be added to the upper edge of the push hood or that of the pull hood so that the flow field is remained as a 2-D flow field and the dispersion of the contaminant caused by the interference of the side flow is reduced.

According to the previous design methods together with the above stated design concepts, a push hood with the highest efficiency of push velocity and pull velocity can be made; and, by the specific design of the push hood structure, the side dispersion of the contaminant flow can be effectively reduced, as shown in the design of the preferred embodiment according to the present invention.

Figure 2:
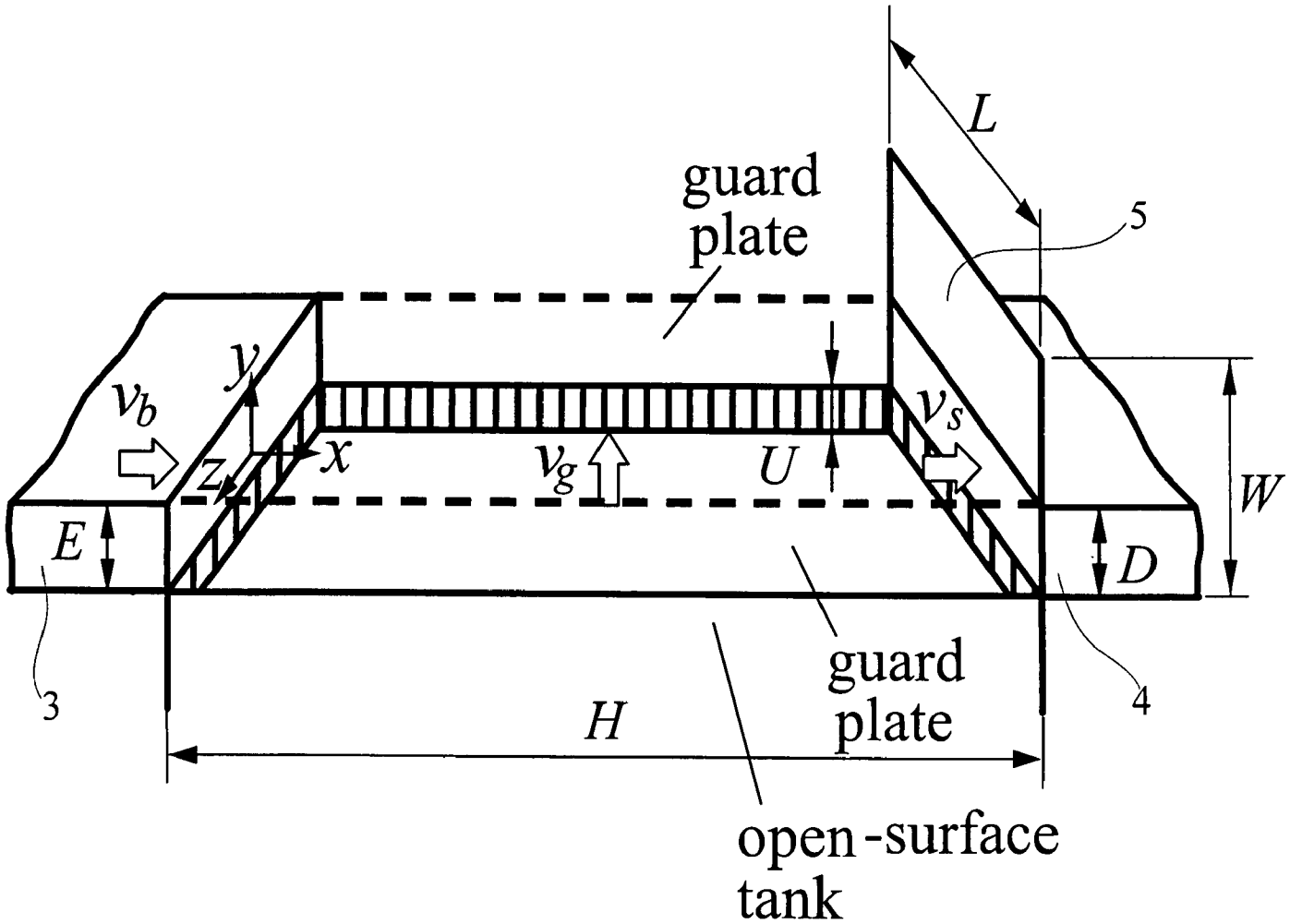
FIG. 2 is a structural view of the push-pull hood of the preferred embodiment according to the present invention.
Figure 3:
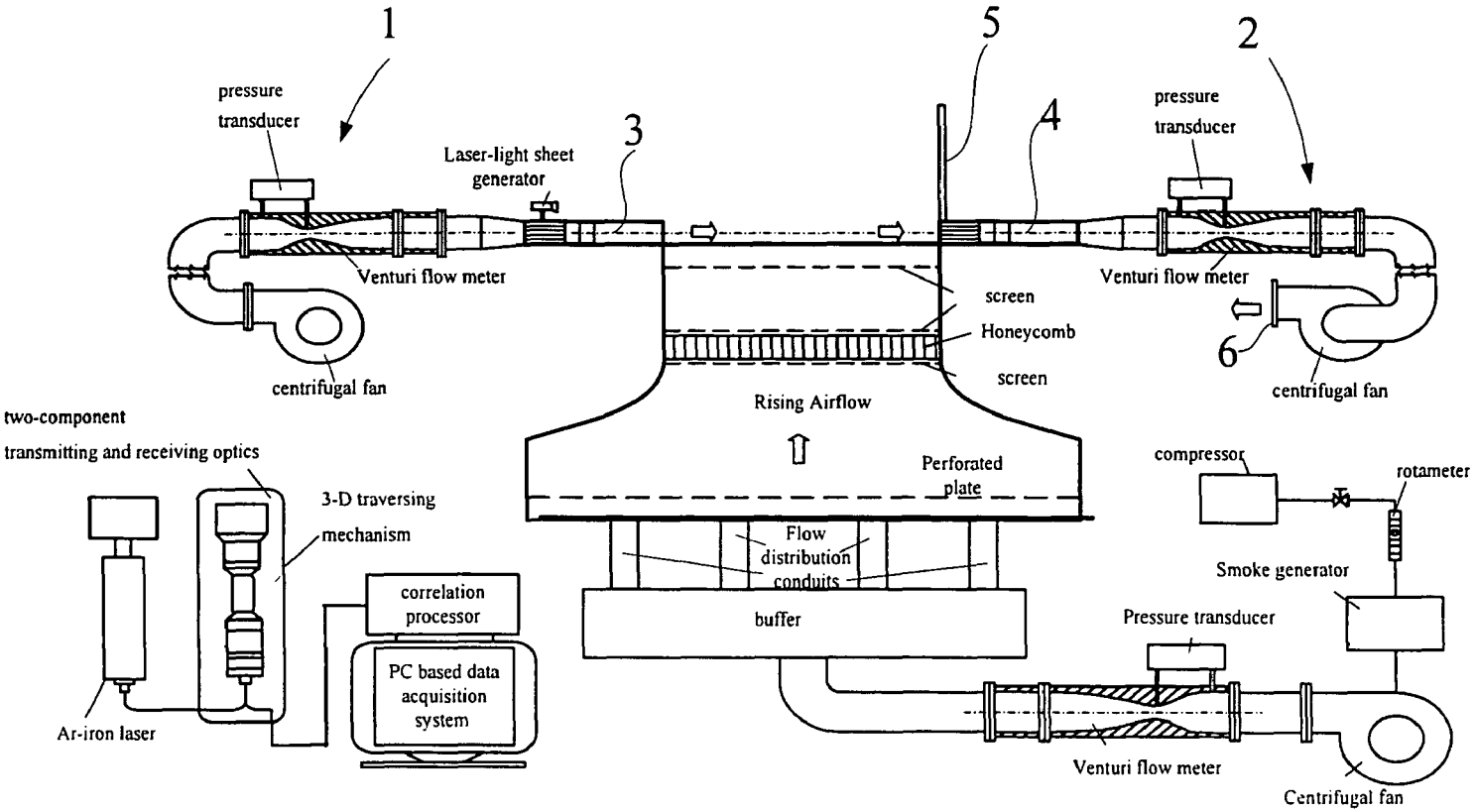
FIG. 3 is an view of the experiment structure of the preferred embodiment according to the present invention.

Please refer to FIG. 2 and FIG. 3, which are a structural view of the push-pull hood and a structural view of the experiment of the preferred embodiment, according to the present invention. As shown in FIG. 2, the push-pull hood according to the present invention comprises a push hood 3, a pull hood 4 and a pull hood flange 5 before the pull hood 4 almost straightly vertical to the direction of the push flow. The experiment parameters of the preferred embodiment denoted on the figure are: vb is the average surface velocity of the push hood opening (i.e. push velocity); E is the push hood opening height; Z is the horizontal coordinate where its origin is at the middle of the lower edge of the push hood opening; Y is the coordinate on the direction of the liquid-surface rising flow where its origin is at the middle of the lower edge of the push hood opening; X is the coordinate on the direction of the push flow where its origin is at the middle of the lower edge of the push hood opening; $v_g$ is the rising velocity of the simulated chemical vapor (i.e. liquid-surface rising velocity); L is the width of the pull hood, the push hood and the chemical tank; $v_s$ is the average surface velocity of the pull hood opening (i.e. pull velocity); H is the chemical tank length; U is the liquid-surface height of the simulated open-surface type chemical tank; and D is the pull hood opening height.

As shown in FIG. 3, the present invention is a push-pull type ventilation hood having a push device 1 to obtain a push flow and a pull device 2 to exhaust contaminant flow with an exhaust opening 6. Therein, the design is characterized in that the pull device 2 comprises a pull hood flange 5 almost straightly vertical to the push flow direction and the pull device 2; and is characterized in that, after the push flow flows through the pull hood flange 5, the flow is exhausted through the exhaust opening 6 of the pull device 2; and is characterized in that the pull hood flange 5 can be made of acrylics.

Figure 4:
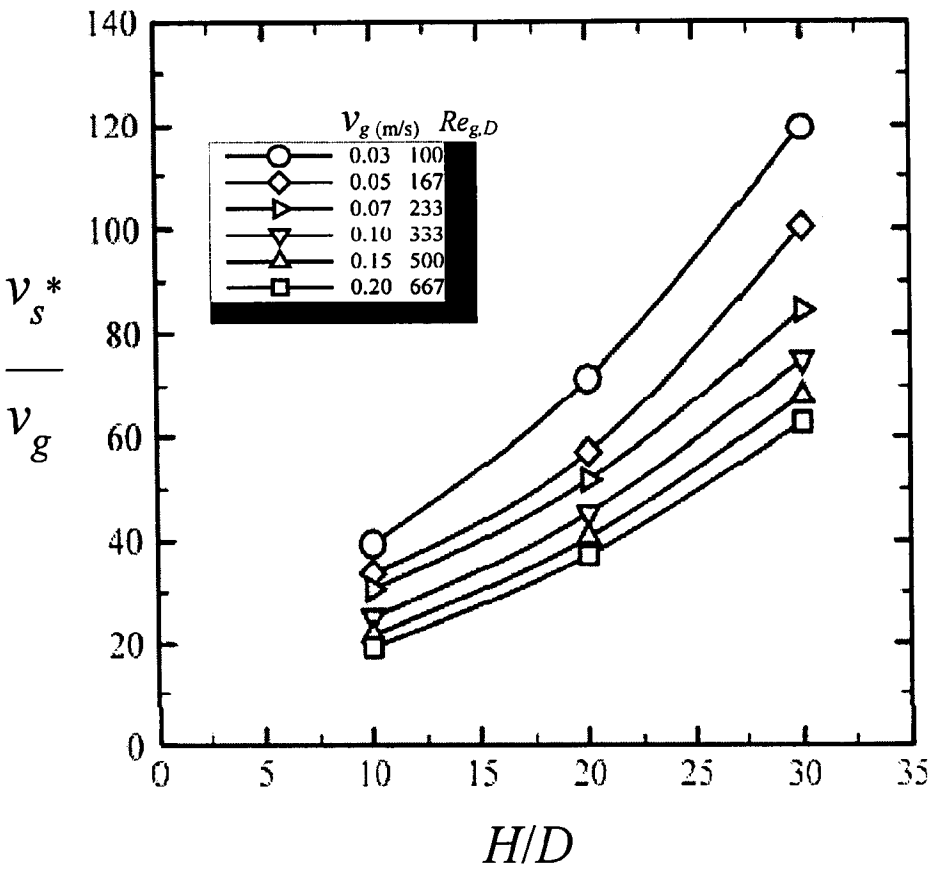
FIG. 4 is a view of the smallest pull velocities ($v_s$*) acquired according to the present invention.
Figure 5:
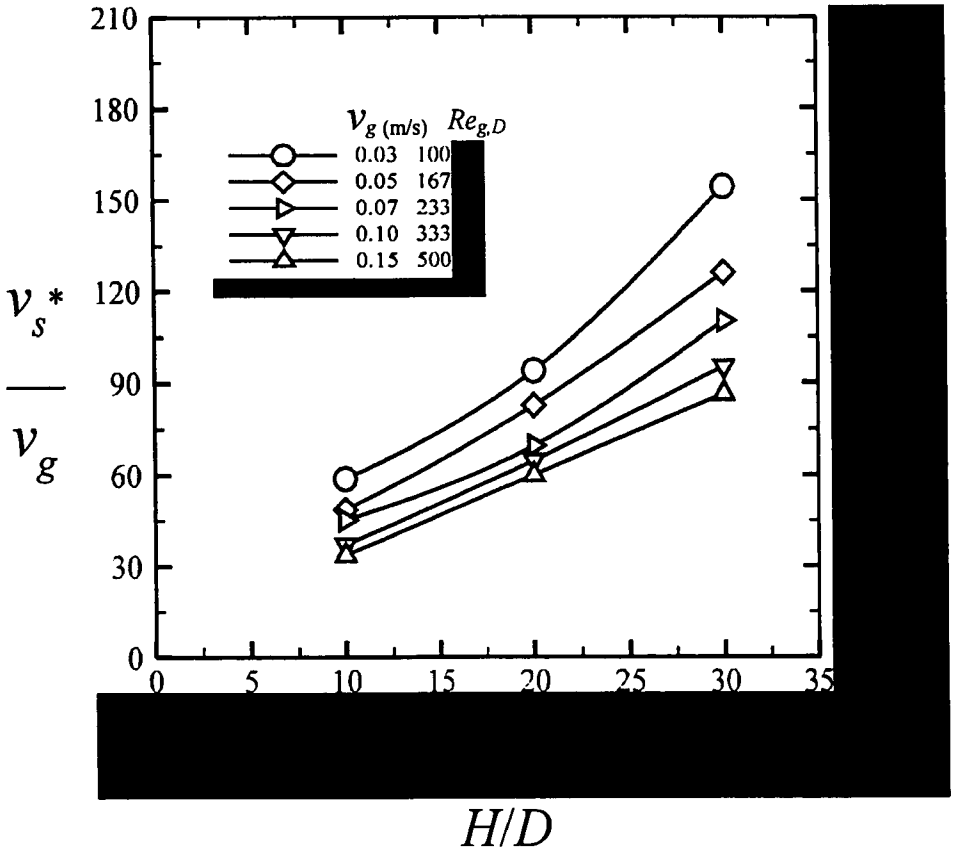
FIG. 5 is another view of the smallest pull velocities acquired according to the present invention.
Figure 6:
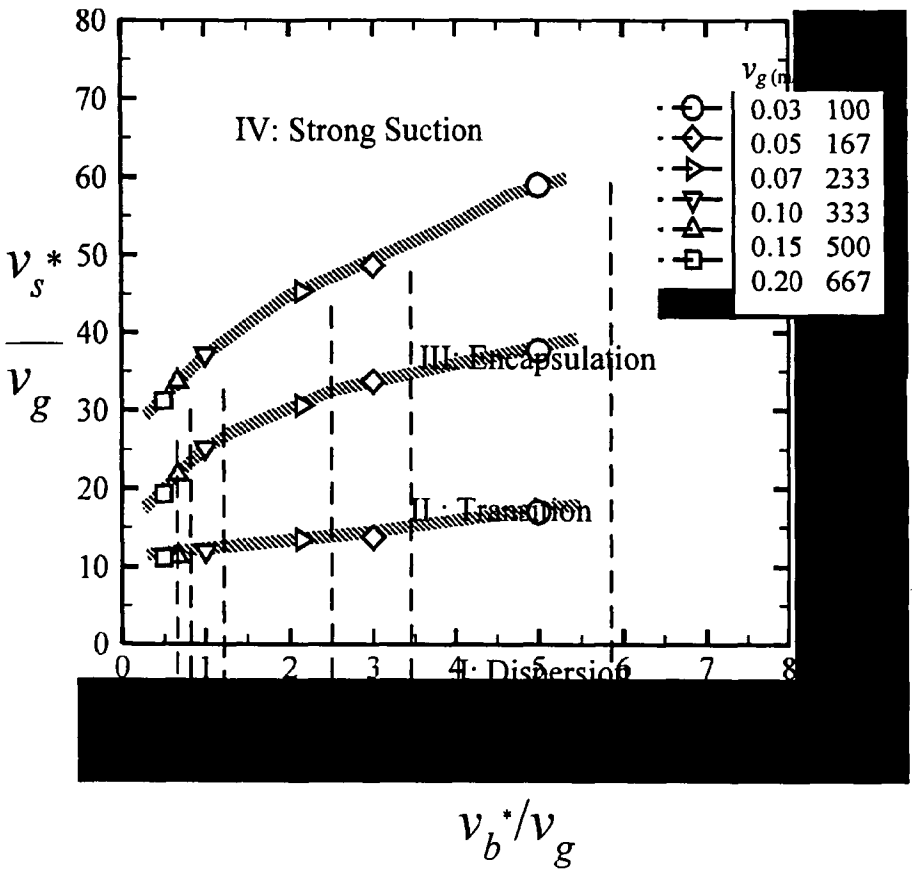
FIG. 6 is a view of the boundaries of the characteristic flow regimes, which shows the smallest push velocities ($v_b$*) by using a simulated chemical tank with a length of 0.5 m (meter) according to the present invention.
Figure 7:
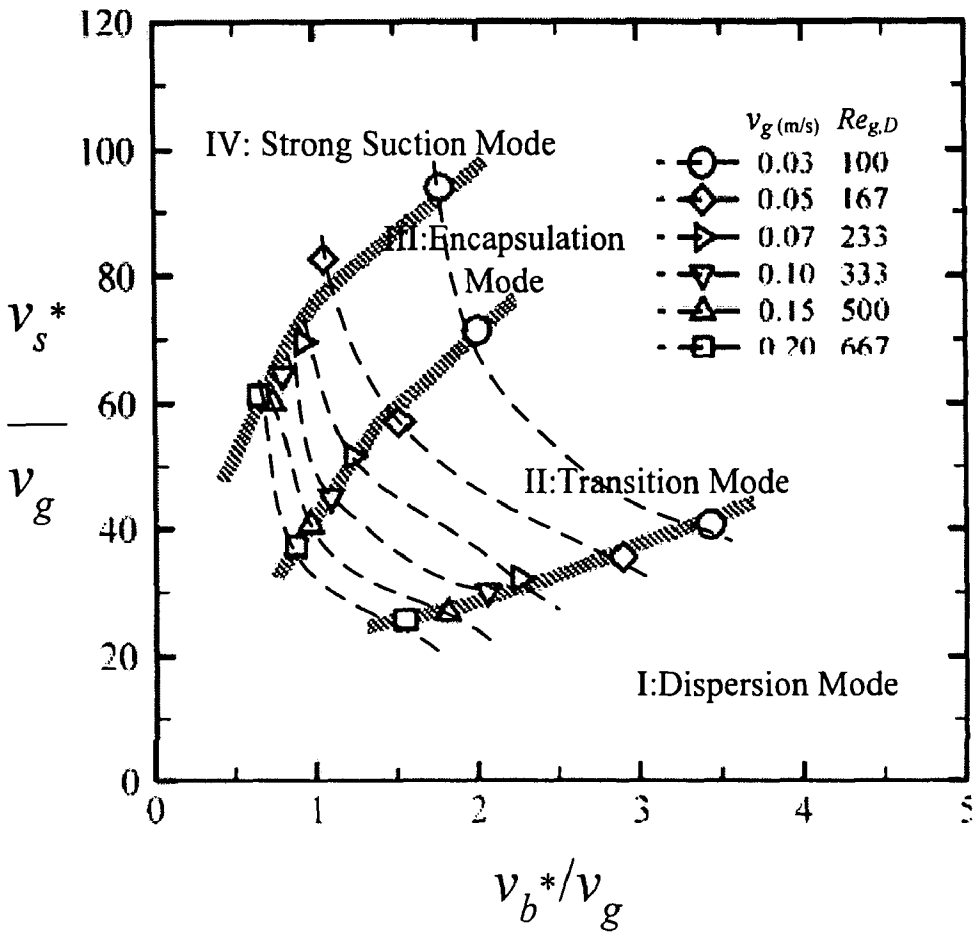
FIG. 7 is a view of the boundaries of the characteristic flow regimes, which shows the smallest push velocities ($v_b$*) by using a simulated chemical tank with a length of 1.0 m according to the present invention.
Figure 8:
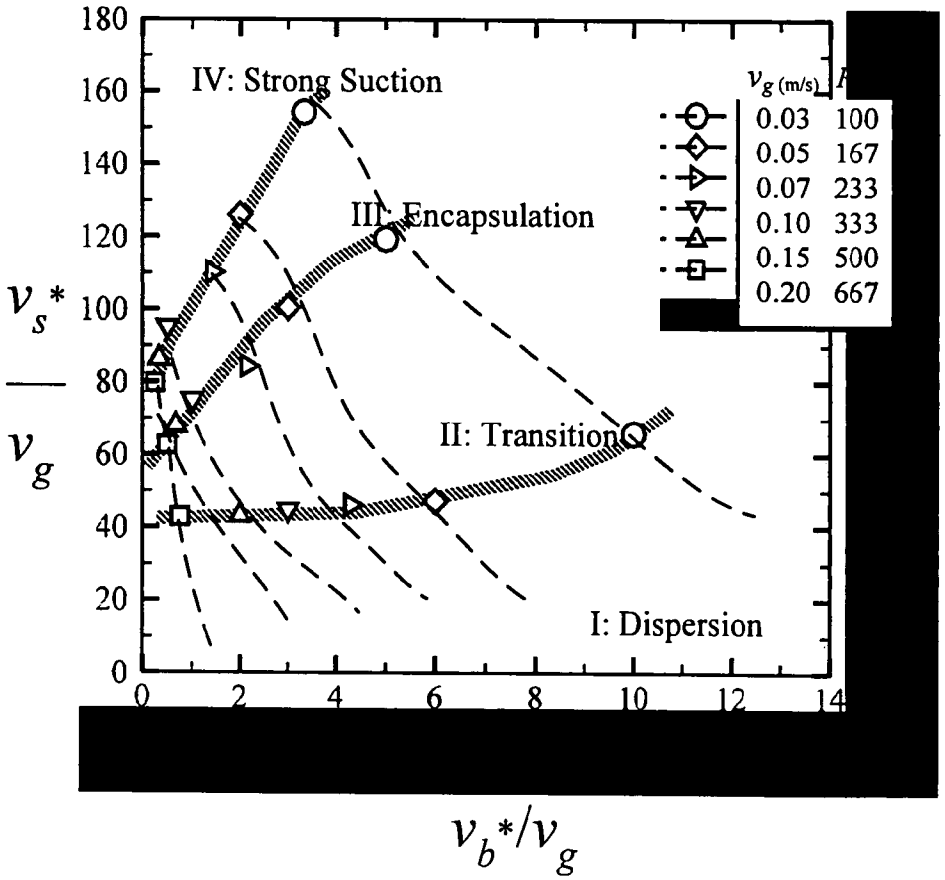
FIG. 8 is a view of the boundaries of the characteristic flow regimes, which shows the smallest push velocities ($v_b$*) by using a simulated chemical tank with a length of 1.5 m according to the present invention.

Please refer to FIG. 4 and FIG. 5, which are views of the smallest pull velocities ($v_s$*) acquired according to the present invention. By referring to FIG. 4 or FIG. 5, a smallest pull velocity ($v_s$*) can be obtained.

views of the boundaries of the characteristic flow regimes, which shows the smallest push velocities ($v_b$*) for a simulated chemical tank according to the present invention, wherein the length of the tank in FIG. 6 is 0.5 m (meter) and that in FIG. 7 is 1.0 m and that in FIG. 8 is 1.5 m Besides, please refer to FIG. 6, FIG. 7 and FIG. 8, which are views of the boundaries of the characteristic flow regimes, which shows the smallest push velocities ($v_b$*) for a simulated chemical tank according to the present invention, wherein the length of the tank in FIG. 6 is 0.5 m (meter) and that in FIG. 7 is 1.0 m and that in FIG. 8 is 1.5 m.

According to the above design methods and design concepts, the preferred embodiment according to the present invention can be made and the push-pull hood made according to the present invention can economically and effectively control the dispersing contaminant source.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. A computer-based method of manufacturing a push-pull type ventilation hood having a push device to obtain a push air flow and a pull device to exhaust contaminant flow with an exhaust opening, when the push flow flows through a contaminant source, a contaminated flow of the push flow is exhausted through the exhaust opening, a pull hood flange is set vertically to the direction of the push flow and the pull device, which comprises the steps of:

a) determining a liquid-surface rising velocity (vg) and a ratio of a chemical tank length (H) to a pull hood opening height (D) (H/D);

b) determining a smallest pull velocity ($v_s^*$) according to a smallest pull velocity definition being:

$$(v_s^*/v_g)=(-1718.285v_g^3+981.659v_g^2-215.819v_g+29.003)\times\exp[(-7.264v_g^3+2.881v_g^2-0.305v_g+0.062)(H/D)];$$

c) determining a smallest push velocity ($v_b^*$) for the smallest pull velocity ($v_s^*$) by referring to a figure showing boundaries of four characteristic flow regimes for a simulated chemical tank having a predetermined length, wherein the four characteristic flow regimes are regimes of dispersion, transition, encapsulation and strong suction;

d) determining a corresponding slope (S) utilizing a corresponding slope-definition;

e) selecting a push velocity ($v_b$) having a value between the smallest push velocity and 1 m/s (meter per second);

f) determining and outputting a pull velocity ($v_s$) utilizing a pull velocity definition defined as:

$$v_s>=v_s^*+S\times(v_b-v_b^*);$$

and g) outputting push-pull type ventilation hood design parameters on a computer based on computer calculations performed in steps a-f.

2. The method according to claim 1, wherein the pull hood flange is made of acrylics.

3. The method according to claim 1, wherein, in the determining step c), the predetermined length of the simulated chemical tank is 0.5 m (meter).

4. The method according to claim 1, wherein, in the determining step c), the predetermined length of the simulated chemical tank is 1.0 m.

5. The method according to claim 1, wherein, in the determining step c), the predetermined length of the simulated chemical tank is 1.5 m.

6. The method according to claim 1, wherein, in the determining step d), the corresponding slope definition is: S=0.0215H/D+2.0756.

7. The method according to claim 1, wherein, in the determining step d), the corresponding slope definition is: S=0.0164H/D+1.6264.

8. A computer-based method for designing a push-pull type ventilation hood having a push device to obtain a push air flow and a pull device to exhaust contaminant flow with an exhaust opening, when the push flow flows through a contaminant source, a contaminated flow of the push flow is exhausted through the exhaust opening, a pull hood flange is set vertically to the direction of the push flow and the pull device, which comprises the steps of:

a) determining a liquid-surface rising velocity (vg) and a ratio of a chemical tank length (H) to a pull hood opening height (D) (H/D);

b) determining a smallest pull velocity ($v_s^*$) according to a smallest pull velocity definition being:

$$(v_s^*/v_g)=(-3362.250v_g^3+1893.890v_g^2-365.600v_g+45.997)\times\exp[(-5.182v_g^3+1.930v_g^2-0.215v_g+0.053)(H/D)];$$

c) determining a smallest push velocity ($v_b^*$) for the smallest pull velocity ($v_s^*$) by referring to a figure showing boundaries of four characteristic flow regimes for a simulated chemical tank having a predetermined length, wherein the four characteristic flow regimes are regimes of dispersion, transition, encapsulation and strong suction;

d) determining a corresponding slope (S) utilizing a corresponding slope definition;

e) selecting a push velocity ($v_b$) having a value between the smallest push velocity and 1 m/s (meter per second);

f) determining and outputting a pull velocity ($v_s$) utilizing a pull velocity definition defined as:

$$v_s >= v_s^* + S \times (v_b - v_b^*);$$

and g) outputting push-pull type ventilation hood design parameters on a computer based on computer calculations performed in steps a-f.

9. The method according to claim 8, wherein the pull hood flange is made of acrylics.

10. The method according to claim 8, wherein, in the determining step c), the predetermined length of the simulated chemical tank is 0.5 m (meter).

11. The method according to claim 8, wherein, in the determining step c), the predetermined length of the simulated chemical tank is 1.0 m.

12. The method according to claim 8, wherein, in the determining step c), the predetermined length of the simulated chemical tank is 1.5 m.

13. The method according to claim 8, wherein, in the determining step d), the corresponding slope definition is: S=0.0215H/D+2.0756.

14. The method according to claim 8, wherein, in the determining step d), the corresponding slope definition is: S=0.0164H/D+1.6264.

* * * * *